US009624928B2

(12) United States Patent
Yamazaki et al.

(10) Patent No.: US 9,624,928 B2
(45) Date of Patent: Apr. 18, 2017

(54) SCROLL-TYPE COMPRESSOR WITH GAS PASSAGE FORMED IN ORBITING PLATE TO RESTRICT FLOW FROM COMPRESSION CHAMBER TO BACK PRESSURE CHAMBER

(71) Applicant: KABUSHIKI KAISHA TOYOTA JIDOSHOKKI, Kariya-shi, Aichi (JP)

(72) Inventors: Jun Yamazaki, Kariya (JP); Atsushi Nishizawa, Kariya (JP); Kenji Maemura, Kariya (JP); Muneharu Murase, Kariya (JP)

(73) Assignee: KABUSHIKI KAISHA TOYOTA JIDOSHOKKI, Kariya-shi, Aichi (JP)

( * ) Notice: Subject to any disclaimer, the term of this patent is extended or adjusted under 35 U.S.C. 154(b) by 100 days.

(21) Appl. No.: 14/511,614

(22) Filed: Oct. 10, 2014

(65) Prior Publication Data

US 2015/0104342 A1 Apr. 16, 2015

(30) Foreign Application Priority Data

Oct. 11, 2013 (JP) ..... 2013-213886

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/02*** | (2006.01) |
| ***F04C 27/00*** | (2006.01) |

(Continued)

(52) U.S. Cl.

CPC ..... *F04C 18/0215* (2013.01); *F04C 18/0261* (2013.01); *F04C 27/005* (2013.01); *F04C 29/0021* (2013.01); *F04C 29/06* (2013.01); *F04C 23/008* (2013.01)

(58) Field of Classification Search

CPC ..... F04C 18/0215; F04C 18/0253; F04C 18/0261; F04C 23/008; F04C 27/005; F04C 29/0021; F04C 29/005; F04C 29/0057; F04C 29/06; F01C 1/0215; F01C 1/0253; F01C 1/0261; F01C 19/08; F01C 19/10; F01C 21/02

USPC ..... 418/55.1–55.6, 57, 270, DIG. 1, 88, 94

See application file for complete search history.

(56) References Cited

U.S. PATENT DOCUMENTS 4,596,520 A * 6/1986 Arata ..... F04C 27/005 418/55.5
4,818,198 A * 4/1989 Tamura ..... F04C 18/0215 418/57

(Continued)

FOREIGN PATENT DOCUMENTS

JP 58-128485 A 8/1983
JP 61011487 A 1/1986

(Continued)

*Primary Examiner* — Theresa Trieu
(74) *Attorney, Agent, or Firm* — Sughrue Mion, PLLC

(57) ABSTRACT

The orbiting base plate has a compression side surface and a back pressure chamber side surface. The gas passage has an opening in the compression side surface of the orbiting base plate between portions of the orbiting spiral wall that face each other, and the gas passage has an opening in the back pressure side surface at a position that faces an area on a radially inner side than the outer circumference of the bearing, so as to feed the refrigerant gas in the compression chamber to the back pressure chamber.

5 Claims, 8 Drawing Sheets

(51) Int. Cl.

| | |
|---|---|
| ***F04C 29/00*** | (2006.01) |
| ***F04C 29/06*** | (2006.01) |
| *F04C 23/00* | (2006.01) |

(56) References Cited

U.S. PATENT DOCUMENTS

| | | | | |
|---|---|---|---|---|
| 5,660,539 | A * | 8/1997 | Matsunaga | F04C 27/005 418/55.5 |
| 6,761,545 | B1 * | 7/2004 | Witham | F04C 18/0215 418/55.5 |
| 7,419,370 | B2 * | 9/2008 | Masuda | F04C 18/0215 418/55.5 |
| 2001/0048886 | A1 * | 12/2001 | Kuroki | F04C 18/0215 418/55.5 |
| 2002/0136654 | A1 | 9/2002 | Gennami et al. | |
| 2011/0243777 | A1 * | 10/2011 | Ito | F04C 18/0215 418/55.5 |
| 2013/0259726 | A1 * | 10/2013 | Yamashita | F04C 18/0215 418/55.1 |

FOREIGN PATENT DOCUMENTS

| | | | |
|---|---|---|---|
| JP | 6-213175 | A | 8/1994 |
| JP | 2001-73973 | A | 3/2001 |
| JP | 2002285980 | A | 10/2002 |
| JP | 2011-64189 | A | 3/2011 |

* cited by examiner

SCROLL-TYPE COMPRESSOR WITH GAS PASSAGE FORMED IN ORBITING PLATE TO RESTRICT FLOW FROM COMPRESSION CHAMBER TO BACK PRESSURE CHAMBER

TECHNICAL FIELD

The technique disclosed in the present specification relates to a scroll-type compressor comprising an orbiting scroll and a fixed scroll.

DESCRIPTION OF RELATED ART

Japanese Patent Application Publication No. 2011-64189 discloses a conventional scroll-type compressor. The conventional scroll-type compressor is provided with an orbiting scroll, a fixed scroll disposed to oppose the orbiting scroll, and a shaft supporting member disposed to oppose the orbiting scroll on the opposite side of the fixed scroll. A compression chamber is foamed between the orbiting scroll and the fixed scroll, and a back pressure chamber is formed between the orbiting scroll and the shaft supporting member. The scroll-type compressor is further provided with a rotation shaft and an eccentric shaft being offset from a rotation center of the rotation shaft. The orbiting scroll is fixed onto the eccentric shaft through a bush and a bearing. The orbiting scroll is provided with an orbiting base plate facing the bearing and a orbiting spiral wall projecting from the orbiting base plate toward the fixed scroll. An air supply passage for feeding refrigerant gas in the compression chamber to the back pressure chamber is formed in the orbiting wall. The air supply passage penetrates the orbiting wall. When the pressure of the refrigerant gas in the back pressure chamber presses the orbiting scroll toward the fixed scroll, a tip-end of the orbiting wall is in contact with the fixed scroll, and an inlet of the air supply passage is closed.

In such a scroll-type compressor, the eccentric shaft orbits by the rotation of the rotation shaft, and the orbiting scroll orbits by the orbiting of the eccentric shaft. When the orbiting scroll orbits, the refrigerant gas in the compression chamber is compressed, and the compressed refrigerant gas is discharged to the outside. When the refrigerant gas in the compression chamber is compressed, the pressure of the refrigerant gas presses the orbiting scroll toward a direction in which the orbiting scroll is separated from the fixed scroll. As a result, the tip-end of the orbiting wall of the orbiting scroll is separated from the fixed scroll, and the inlet of the air supply passage is opened. Then, a part of the refrigerant gas in the compression chamber flows into the air supply passage, and the refrigerant gas is fed to the back pressure chamber through the air supply passage. Thereafter, the refrigerant gas passes through gaps between the bearing and the bush and flows into the back pressure chamber. The flow of the refrigerant gas into the back pressure chamber increases the pressure of the refrigerant gas in the back pressure chamber, and such pressure presses the orbiting scroll toward to the fixed scroll. In this manner, the orbiting scroll is pressed toward the fixed scroll, thus preventing the orbiting scroll to be excessively separated from the fixed scroll when the refrigerant gas is compressed.

BRIEF SUMMARY OF INVENTION

In the above-described scroll-type compressor, when the tip-end of the orbiting wall is separated from the fixed scroll by the pressure of the refrigerant gas in the compression chamber, the refrigerant gas is fed to the back pressure chamber through the air supply passage. Then, the pressure of the refrigerant gas fed to the back pressure chamber presses the orbiting scroll toward the fixed scroll. Therefore, when the refrigerant gas is fed from the compression chamber to the back pressure chamber, the orbiting scroll first moves to a direction separate from the fixed scroll by the pressure of the refrigerant gas in the compression chamber, and then conversely moves to a direction approaching the fixed scroll by the pressure of the refrigerant gas in the back pressure chamber. Such movement of the orbiting scroll causes repeated contact and separation between the orbiting scroll and the fixed scroll, and noises and vibration may be occurred when the orbiting scroll is brought into contract with the fixed scroll.

In view of the above aspects, the present specification aims at providing a scroll-type compressor that can be operated silently.

A scroll-type compressor disclosed in the present specification comprises a rotation shaft; an eccentric shaft fixed to the rotation shaft, the eccentric shaft being offset from a rotation center of the rotation shaft; a bush fitted onto the eccentric shaft; and a bearing disposed rotatably relative to the bush. The scroll-type compressor comprises an orbiting scroll supported by the bearing; a fixed scroll disposed to oppose the orbiting scroll; and a partition wall supporting the rotation shaft and forming a back pressure chamber together with the orbiting scroll, wherein pressure in the back pressure chamber presses the orbiting scroll toward the fixed scroll. The orbiting scroll comprises an orbiting base plate and an orbiting spiral wall projecting from the orbiting base plate toward the fixed scroll. The fixed scroll comprises a fixed base plate facing the orbiting base plate, and a fixed spiral wall projecting from the fixed base plate toward the orbiting scroll. The orbiting wall, the fixed wall, the orbiting base plate and the fixed base plate form a compression chamber. Refrigerant gas in the compression chamber is compressed in accordance with the orbiting motion of the orbiting scroll caused by the rotation of the rotation shaft through the revolution of the eccentric shaft. A gas passage is formed in the orbiting base plate so as to communicate the compression chamber and the back pressure chamber. The orbiting base plate has a compression side surface and a back pressure chamber side surface, wherein the gas passage has an opening in the compression side surface of the orbiting base plate between portions of the orbiting spiral wall that face each other, and the gas passage has an opening in the back pressure side surface at a position that faces an area on a radially inner side than the outer circumference of the bearing, so as to feed the refrigerant gas in the compression chamber to the back pressure chamber.

According to such a configuration, when the rotation shaft is rotated, the orbiting scroll orbits and the refrigerant gas in the compression chamber is compressed. A part of the compressed refrigerant gas is fed toward the back pressure chamber through the gas passage formed in the orbiting base plate of the orbiting scroll. Thereafter, the refrigerant gas passes through gaps between the bush and the bearing in the back pressure chamber. The flow of the refrigerant gas into the back pressure chamber increases the pressure in the back pressure chamber, and this pressure presses the orbiting scroll toward to the fixed scroll. The orbiting scroll is pressed toward the fixed scroll and thus supported, thereby preventing the orbiting scroll to be separated from the fixed scroll when the refrigerant gas is compressed. In this scroll-type compressor, the orbiting base plate of the orbiting scroll comprises the gas passage. Thus, even when the tip-end of the orbiting wall of the orbiting scroll is not separated from the fixed scroll, the refrigerant gas can flow from the compression chamber toward the back pressure chamber. As a result, it is possible to suppress repeated contact and separation between the orbiting scroll and the fixed scroll and suppress the collision of the orbiting scroll on the fixed scroll. Therefore, it is possible to operate the scroll-type compressor silently. Moreover, an area facing an opening portion of the gas passage has high pressure close to discharge pressure because the refrigerant gas taken in on the outer circumference of the compressor is compressed as it moves toward a center side. Thus, it is possible to certainly increase pressure of the back pressure chamber and promote lubrication of the bearing and the bush by lubricating oil contained in the refrigerant gas.

DETAILED DESCRIPTION OF INVENTION

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved scroll type compressors, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Figure 1:
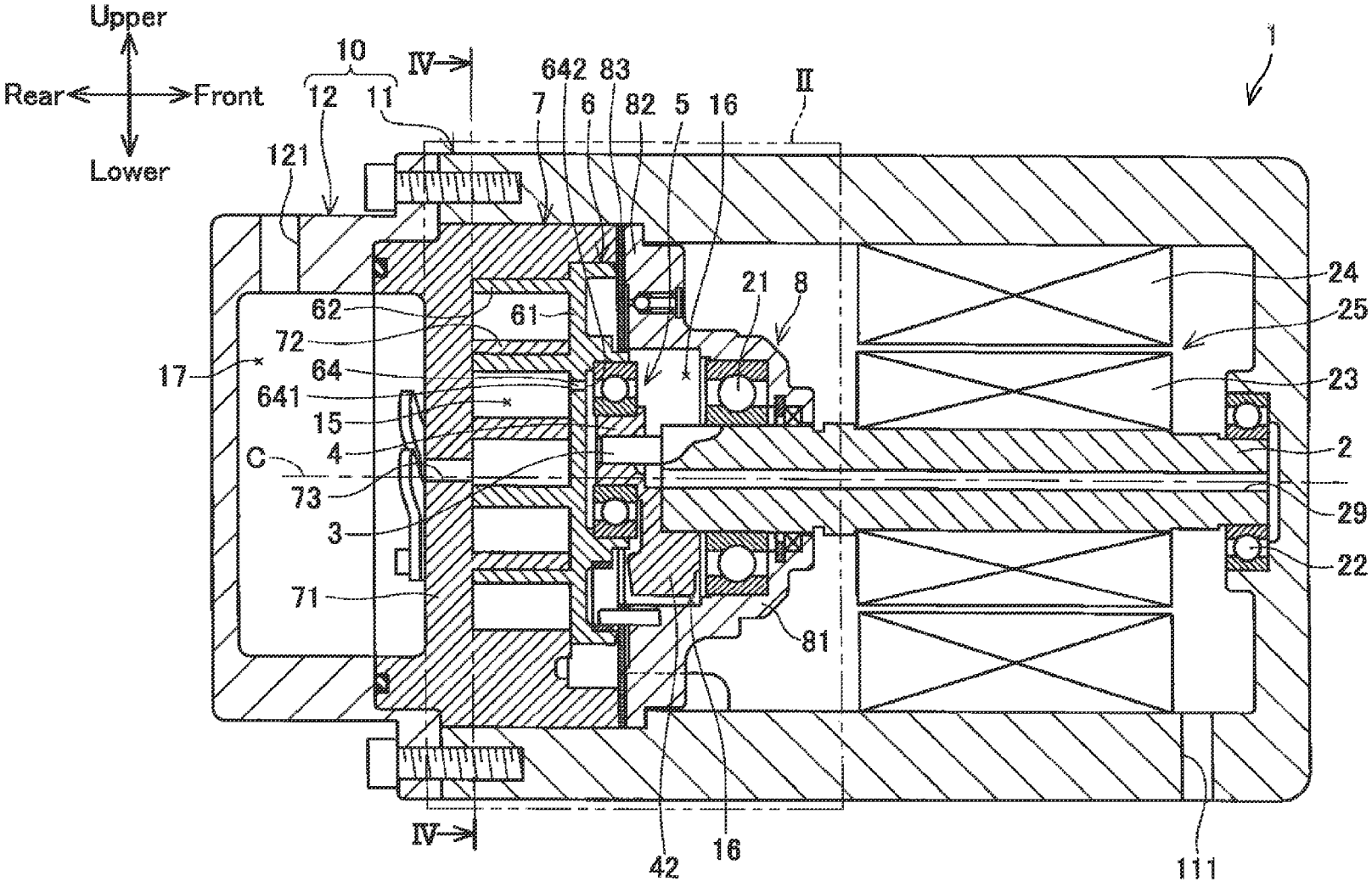
FIG. 1 is a longitudinal sectional view of a scroll-type compressor according to an embodiment.
Figure 2:
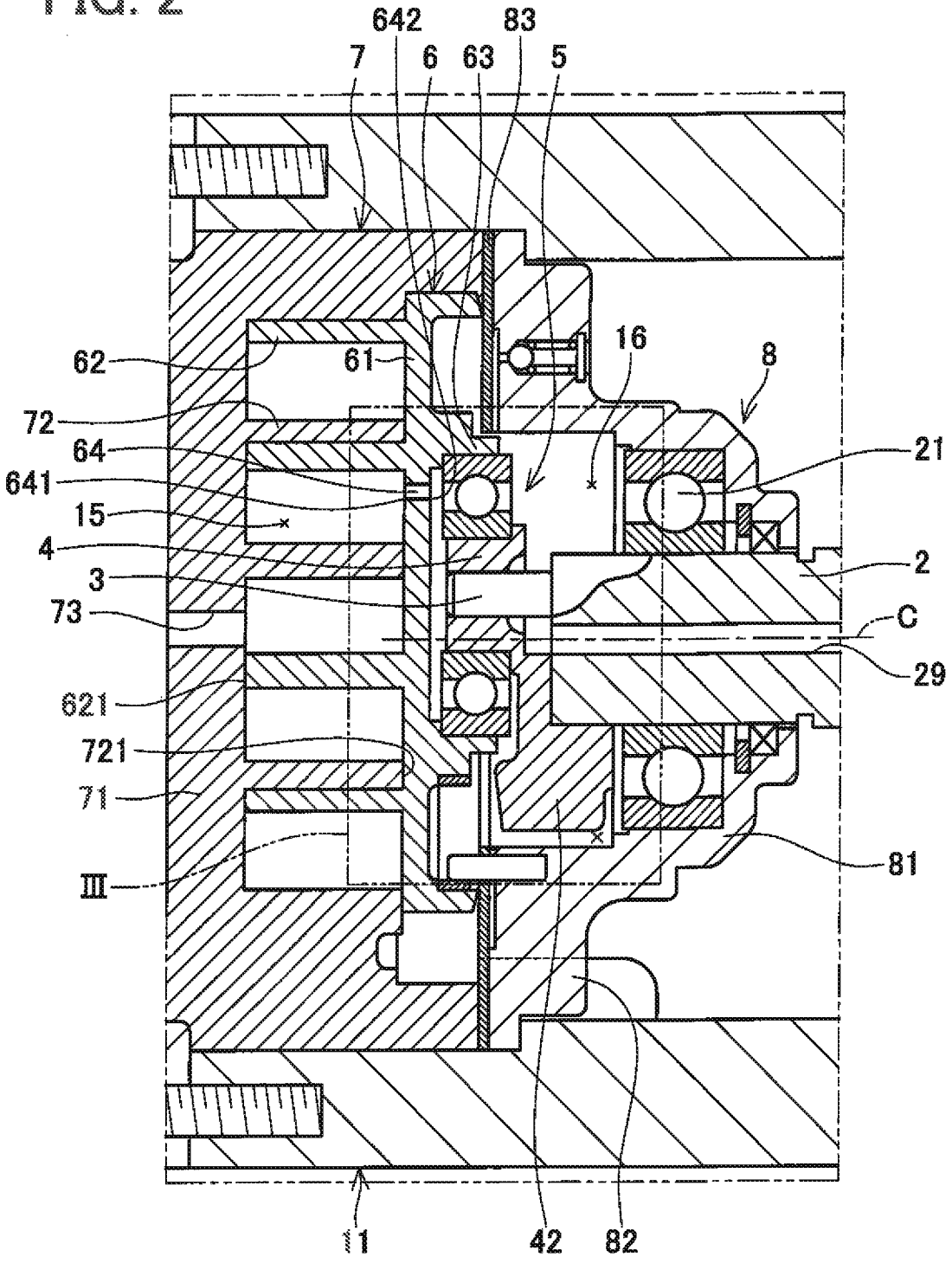
FIG. 2 is an enlarged view of a main portion II of FIG. 1.
Figure 3:
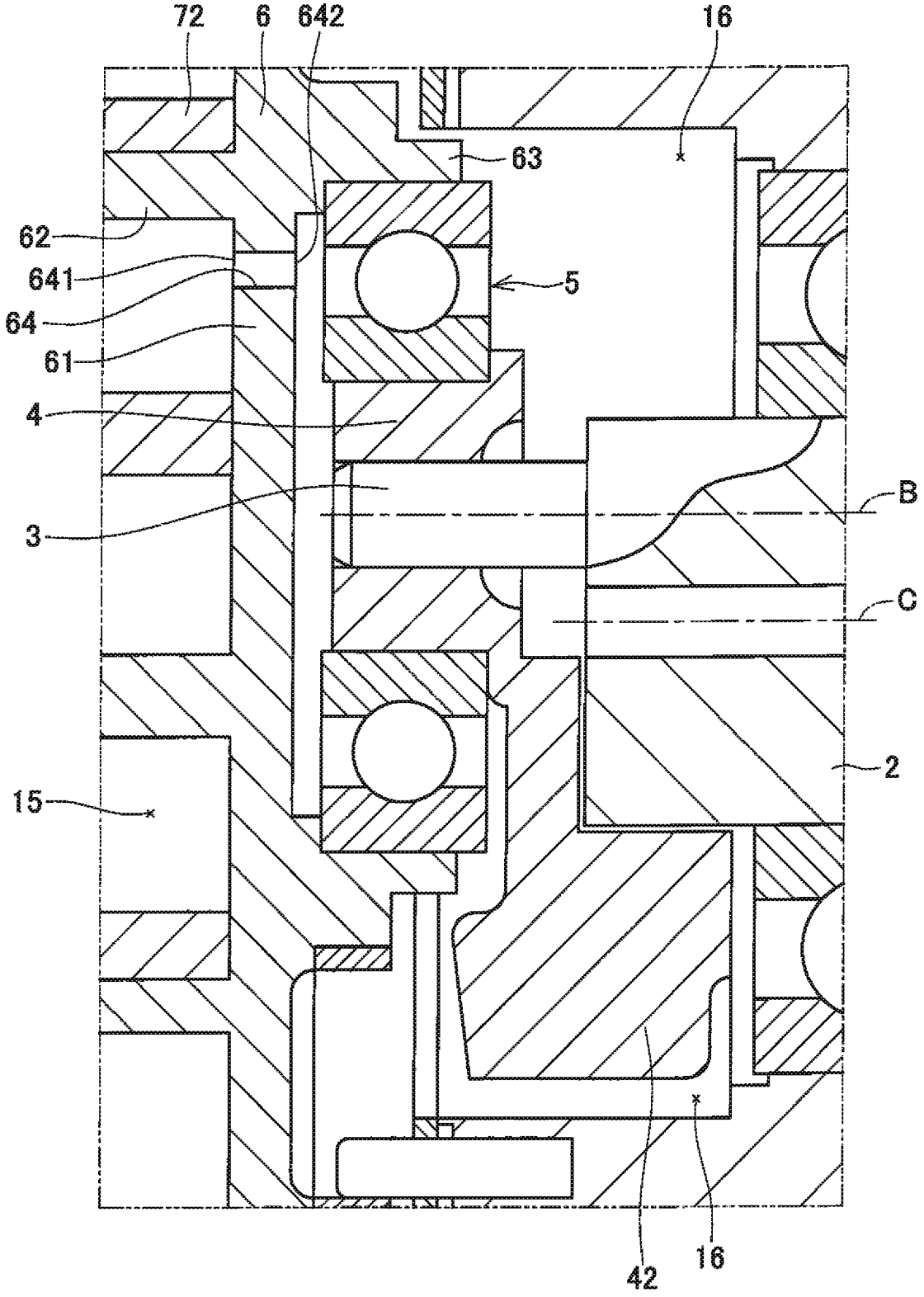
FIG. 3 is an enlarged view of a main portion III of FIG. 2.

In the following, embodiments will be described with reference to the attached drawings. As illustrated in FIG. 1 to FIG. 3, a scroll-type compressor 1 comprises a rotation shaft 2, eccentric shaft 3 being offset from a rotation center C of the rotation shaft 2, a bush 4 fitted onto the eccentric shaft 3, and a bearing 5 disposed rotatably relative to the bush 4. Moreover, the scroll-type compressor 1 comprises an orbiting scroll 6 supported by the bush 4 through the bearing 5, a fixed scroll 7 disposed to oppose the orbiting scroll 6, and a partition wall 8 disposed to oppose the orbiting scroll 6 on the opposite side of the fixed scroll 7. An annular elastic plate 83 is interposed between the fixed scroll 7 and the partition wall 8. A compression chamber 15 is formed between the orbiting scroll 6 and the fixed scroll 7, and a back pressure chamber 16 is formed between the orbiting scroll 6 and the partition wall 8. The above-described components are disposed in a housing 10.

The housing 10 comprises a front housing 11 on a front side and a rear housing 12 on a rear side. The front housing 11 and the rear housing 12 are formed to have a bottomed cylindrical shape, and disposed to oppose each other and be fixed by bolts. The front housing 11 comprises a suction port 111 for sucking refrigerant gas into the housing 10. The rear housing 12 comprises a discharge chamber 17 to which the coolant is discharged from the compression chamber 15 and an exhaust port 121 for exhausting the refrigerant gas in the discharge chamber 17.

The rotation shaft 2 is disposed to extend in a front-rear direction in the front housing 11. The rotation shaft 2 extends by penetrating the partition wall 8 disposed in the front housing 11. The rotation shaft 2 is supported rotatably by a main bearing 21 and a sub bearing 22. The main bearing 21 is disposed in a center of the partition wall 8 to support one end of the rotation shaft 2. The sub bearing 22 is disposed in a center of a front wall of the front housing 11 to support the other end of the rotation shaft 2. A rotor 23 and a stator 24 are disposed around the rotation shaft 2. The rotation shaft 2, the rotor 23, and the stator 24 constitute a motor 25, and the rotation shaft 2 is rotated by the operation of the motor 25.

An exhaust passage 29 extending in a axial direction is formed in the rotation shaft 2. One end of the exhaust passage 29 communicates with the back pressure chamber 16, and the other end thereof communicates with the inside of the front housing 11. The refrigerant gas in the back pressure chamber 16 can be exhausted to the inside of the front housing 11 through the exhaust passage 29. The refrigerant gas exhausted from the exhaust passage 29 passes through gaps of the sub bearing 22 and flows into the front housing 11.

The eccentric shaft 3 is fixed on the rotation shaft 2 and extends in parallel with the rotation shaft 2. Moreover, the eccentric shaft 3 is fixed on a position offset from the rotation center C of the rotation shaft 2. When the rotation shaft 2 rotates, the eccentric shaft 3 orbits around the rotation center C of the rotation shaft 2. A tip-end of the eccentric shaft 3 is inserted in the bush 4.

The bush 4 is formed in a substantially cylindrical shape and fitted onto the eccentric shaft 3. When the rotation shaft 2 rotates, the bush 4 revolves around the rotation center C of the rotation shaft 2, together with the eccentric shaft 3. A balance weight 42 is attached on the bush 4. The balance weight 42 is a substantially-fan-shaped member for canceling centrifugal force generated by the orbiting of the orbiting scroll 6, and is disposed to project from the end, on the side of the rotation shaft 2, of the bush 4. The balance weight 42 is formed on the opposite side to the eccentric shaft 3 with respect to the rotation center C.

The bearing 5 is disposed between an outer peripheral surface of the bush 4 and the orbiting scroll 6. The orbiting scroll 6 is rotatably supported by the bush 4 through the bearing 5. As the bearing 5, there is used a known ball bearing with balls disposed between a pair of ring-shaped races for receiving a load.

Figure 4:
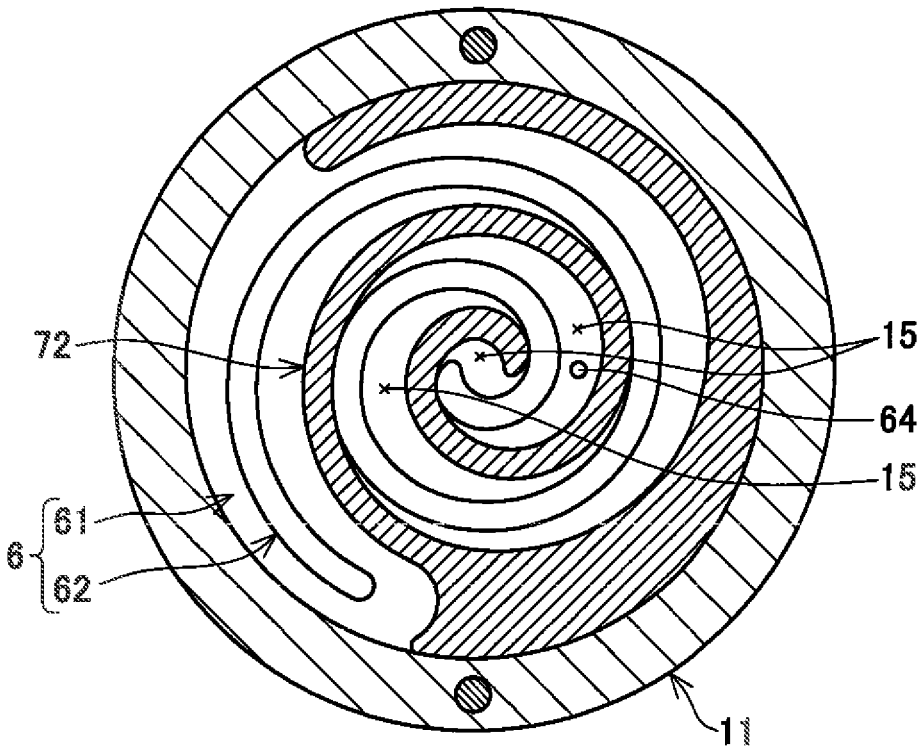
FIG. 4 is a sectional view in IV-IV of FIG. 1.

The orbiting scroll 6 is disposed on the rear side of the bush 4 and the bearing 5. The orbiting scroll 6 comprises a disk-shaped orbiting base plate 61 facing the bearing 5 and a orbiting spiral wall 62 (see FIG. 4) projecting from the disk-shaped orbiting base plate 61 toward the fixed scroll 7. On the other hand, the fixed scroll 7 is disposed on the rear side of the orbiting scroll 6. The fixed scroll 7 comprises a disk-shaped fixed base plate 71 facing the orbiting base plate 61 and a fixed spiral wall 72 (see FIG. 4) projecting from the disk-shaped fixed base plate 71 toward the orbiting scroll 6. The base plates 61 and 71 of the orbiting scroll 6 and the fixed scroll 7 are facing each other, and the walls 62 and 72 of the orbiting scroll 6 and the fixed scroll 7 are disposed to be engaged with each other. Moreover, centers of the orbiting scroll 6 and the fixed scroll 7 are separate from each other, and the phases of the spiral-shaped walls 62 and 72 deviate each other (see FIG. 4).

The orbiting scroll 6 comprises a cylindrical boss 63 projecting from the orbiting base plate 61 toward the bearing 5. The bearing 5 is inserted in the boss 63. The back pressure chamber 16 is divided, by the bearing 5 and the bush 4, to upstream-side back pressure space 16*a* and downstream-side back pressure space 16*b*. A tip-end 621 of the orbiting wall 62 of the orbiting scroll 6 is in contact with the fixed base plate 71 of the fixed scroll 7 while lubricating oil contained in the refrigerant gas is between the tip-end 621 and the fixed base plate 71. The orbiting wall 62 is formed to spirally extend outward from a center of the orbiting base plate 61 (see FIG. 4). The orbiting base plate 61 comprises a single gas passage 64 for feeding the refrigerant gas in the compression chamber 15 to the back pressure chamber 16. The gas passage 64 penetrates the orbiting base plate 61 at a position separate from a root of the orbiting wall 62.

The gas passage 64 comprises an opening of a gas inlet 641 open to the compression chamber 15 and an opening of a gas outlet 642 open to the opposite side of the opening of the gas inlet 641. The gas passage 64 is formed by a same cross-section area from the opening of the gas inlet 641 to the opening of the gas outlet 642. The gas passage 64 is formed in a center of the orbiting base plate 61. The gas passage 64 is formed to be facing the bearing 5. To be more specific, the gas passage 64 is formed to oppose an area of the bearing 5 that is on an inner side than an outer circumference of the bearing 5 and on a radially outer side than a radially inner circumference of the bearing 5 (see FIG. 3). Therefore, the refrigerant gas passing the gas passage 64 from the compression chamber 15 flows into the upstream-side back pressure space 16*a* of the back pressure chamber 16. Then, the refrigerant gas flows toward the bearing 5, passes through gaps of the bearing 5, and flows into the downstream-side back pressure space 16*b*. The gas passage 64 is open between portions of the orbiting wall 62 that adjacently oppose each other within the spiral shape. That is, the gas passage 64 is formed at a position separated from the orbiting wall 62. The orbiting base plate 61 has a compression side surface and a back pressure chamber side surface. The gas passage 64 has an opening 641 in the compression side surface of the orbiting base plate 61 between portions of the orbiting spiral wall 62 that face each other. The gas passage 64 has an opening 642 in the back pressure side surface at a position that faces an area on a radially inner side than the outer circumference of the bearing 5. The openings 641, 642 feed the refrigerant gas in the compression chamber to the back pressure chamber.

The fixed scroll 7 is fixed on the housing 10. A discharge port 73 for discharging refrigerant gas is formed in the fixed scroll 7. The discharge port 73 penetrates the fixed base plate 71 of the fixed scroll 7 and communicates with the compression chamber 15. The refrigerant gas compressed in the compression chamber 15 is discharged to the discharge chamber 17 through the discharge port 73, and then discharged to the outside through the exhaust port 121. A tip-end 721 of the fixed wall 72 of the fixed scroll 7 is in contact with the orbiting base plate 61 of the orbiting scroll 6, in a lubricated state by lubricating oil contained in the refrigerant gas. The fixed wall 72 is formed to spirally extend outward from a center of the fixed base plate 71 (see FIG. 4).

The partition wall 8 comprises a main body 81 and a fixing part 82 projecting toward the periphery from the main body 81. The main body 81 is disposed in a center of the housing 10, and the fixing part 82 is fixed on a side wall of the housing 10. In the partition wall 8, the main body 81 projects forward from the fixing part 82, and the center of the partition wall 8 is recessed. The back pressure chamber 16 surrounded by the main body 81 and the fixing part 82 is formed between the partition wall 8 and the orbiting scroll 6. A gas supply passage (not illustrated) for supplying the refrigerant gas in the front housing 11 to the compression chamber 15 is formed in the fixed scroll 7 and the partition wall 8.

The compression chamber 15 is surrounded by the orbiting base plate 61 and the orbiting wall 62 of the orbiting scroll 6 and the fixed base plate 71 and the fixed wall 72 of the fixed scroll 7. The compression chamber 15 is surrounded by the orbiting spiral wall 62 and fixed wall 72, whereby crescent-shaped spaces are formed respectively (see FIG. 4). In the compression chamber 15, when the orbiting scroll 6 orbits relative to the fixed scroll 7, the compression chamber 15 defined on an radially outer side of the orbiting scroll 6 and the fixed scroll 7 is moved to a radially center side and the volume of the compression chamber 15 is reduced. The refrigerant gas in the compression chamber 15 is compressed to discharge pressure and discharged through the discharge port 73. Moreover, a part of the refrigerant gas in the compression chamber 15 flows into the gas passage 64 of the orbiting scroll 6.

In the back pressure chamber 16, the refrigerant gas passes through the bush 4 and the bearing 5. The refrigerant gas in the back pressure chamber 16 presses the orbiting scroll 6 toward the fixed scroll 7.

Next, the operation of the scroll-type compressor having the above-described configuration will be described. First, when the motor 25 is operated, the rotation shaft 2 rotates, and the eccentric shaft 3 orbits by the rotation of the rotation shaft 2. When the eccentric shaft 3 orbits, the orbiting scroll 6 orbits, and the orbiting of the orbiting scroll 6 compresses the refrigerant gas in the compression chamber 15. The compressed refrigerant gas is discharged to the discharge chamber 17 through the discharge port 73 of the fixed scroll 7. Moreover, a part of the refrigerant gas being compressed flows into the gas passage 64 formed in the orbiting base plate 61 of the orbiting scroll 6. The refrigerant gas flowing into the gas passage 64 flows into the back pressure chamber 16 and passes between the bush 4 and the bearing 5, between the bush 4 and the eccentric shaft 3, between the bearing 5 and the boss 63, and between the races of the bearing 5. Thus, the pressure of the entire refrigerant gas in the back pressure chamber 16 is increased, and this pressure presses the orbiting scroll 6 toward the fixed scroll 7. In this manner, the orbiting scroll 6 is pressed toward the fixed scroll 7 and is thus stabilized, thereby preventing from repeating contact and separation between the orbiting scroll 5 and the fixed scroll 7 when the refrigerant gas is compressed.

As is clear from the above description, the gas passage 64 is formed in the orbiting base plate 61 of the orbiting scroll 6. Thus, the refrigerant gas can flow from the compression chamber 15 to the back pressure chamber 16 without separation of the tip-end of the orbiting wall of the orbiting scroll from the fixed scroll, as in the configuration of Japanese Patent Application Publication No. 2011-64189. Consequently, it is possible to supply the refrigerant gas in the compression chamber 15 to the back pressure chamber 16 without depending on separation of the orbiting scroll 6 and the fixed scroll 7 and suppress contact and separation between the orbiting scroll 6 and the fixed scroll 7, and to suppress the collision of the orbiting scroll 6 on the fixed scroll 7. Therefore, it is possible to operate the scroll-type compressor 1 while the noise is suppressed.

Moreover, the gas passage 64 is formed to be facing an area on a radially inner side than the outer circumference of the bearing 5 and a radially outer side than the inner circumference of the bearing 5. Thus, the gas passage 64 is positioned at a center in a radial direction of the orbiting base plate 61 where the pressure in the compression chamber 15 is highest. Therefore, it is possible to reliably increase the pressure of the back pressure chamber 16 and supply lubricating oil contained in the refrigerant gas to sliding surfaces of the bush 4 and the bearing 5 when the refrigerant gas passes through the bearing 5 and gaps between the bush 4 and the bearing 5, so as to promote lubrication of the sliding surfaces of the bush 4 and the bearing 5.

It should be noted that in the embodiment, the gas passage 64 is designed to be closed, by the orbiting of the orbiting scroll 6, with an orbiting angle of the orbiting scroll 6 being in a given range in the way that the tip-end 721 of the fixed wall 72 is facing the gas passage 64, and designed to be open with the orbiting angle being out of the given range. In this case, the gas passage 64 does not continuously communicate with the back pressure chamber 16. Therefore, it is possible to prevent the case in which the pressure of the back pressure chamber 16 is increased and the pressing force of pressing the orbiting scroll 6 to a direction toward the fixed scroll 7 becomes excessively large. Moreover, it is possible to suppress the decrease of compression efficiency due to the outflow of the refrigerant gas in the compression chamber 15. Furthermore, it is possible to periodically guide the refrigerant gas into the back pressure chamber 16 through the gas passage 64 and stably maintain the pressure of the back pressure chamber 16.

In the embodiment, the gas passage 64 is formed not in the orbiting wall 62 of the orbiting scroll 6 but in the orbiting base plate 61. In case the gas passage is cut through in the orbiting wall 62 projecting from the orbiting base plate 61, the gas passage penetrates the orbiting wall 62 in an axial direction. In this case, it is necessary to increase the thickness of the orbiting wall 62 to secure the strength of the orbiting wall 62, which makes it difficult to achieve light weight. In the embodiment, the gas passage 64 is provided in the orbiting base plate 61, and it is possible to achieve both noise reduction and light weight.

Figure 5:
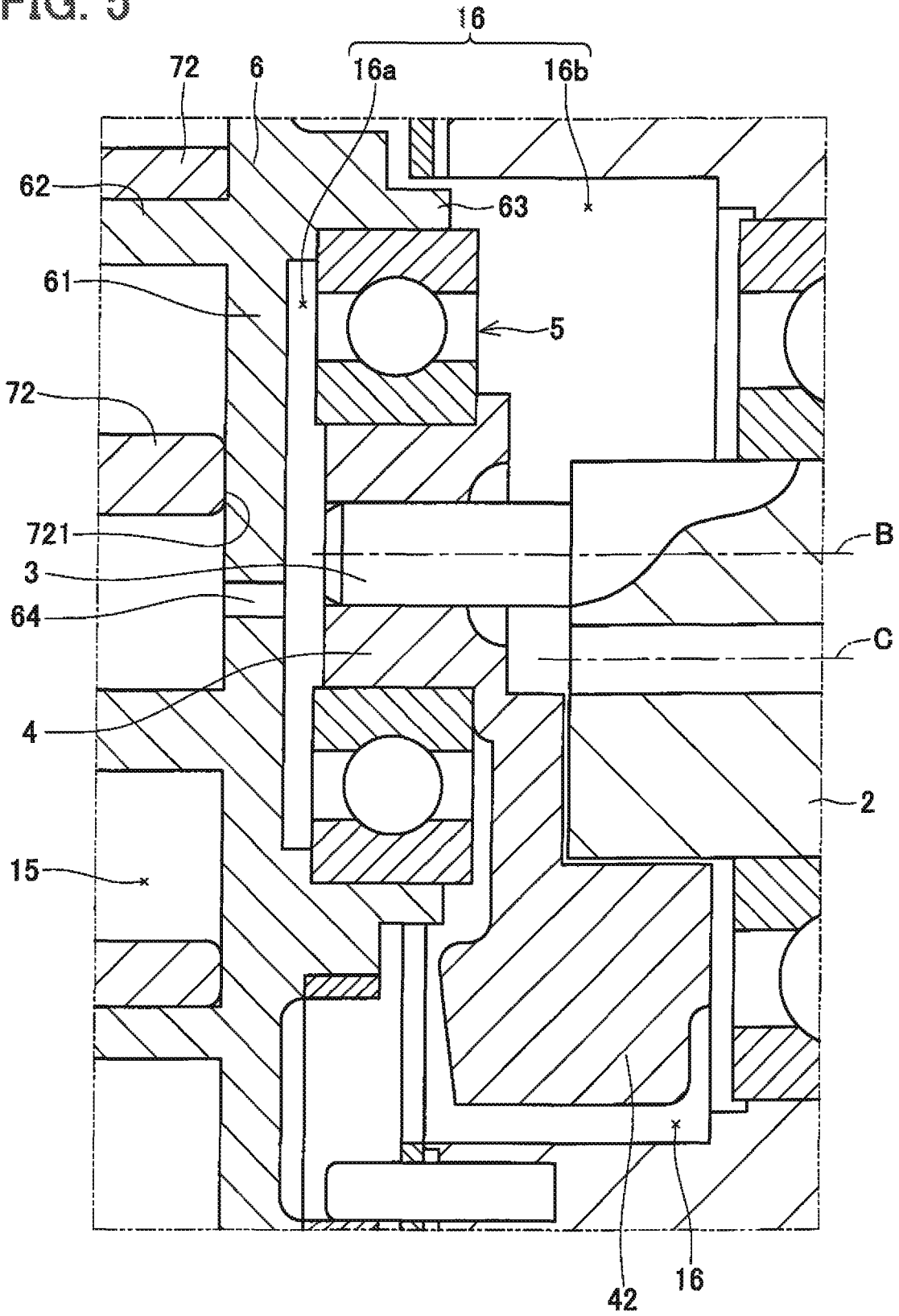
FIG. 5 is an enlarged view of a main portion of a scroll-type compressor according to another embodiment.
Figure 6:
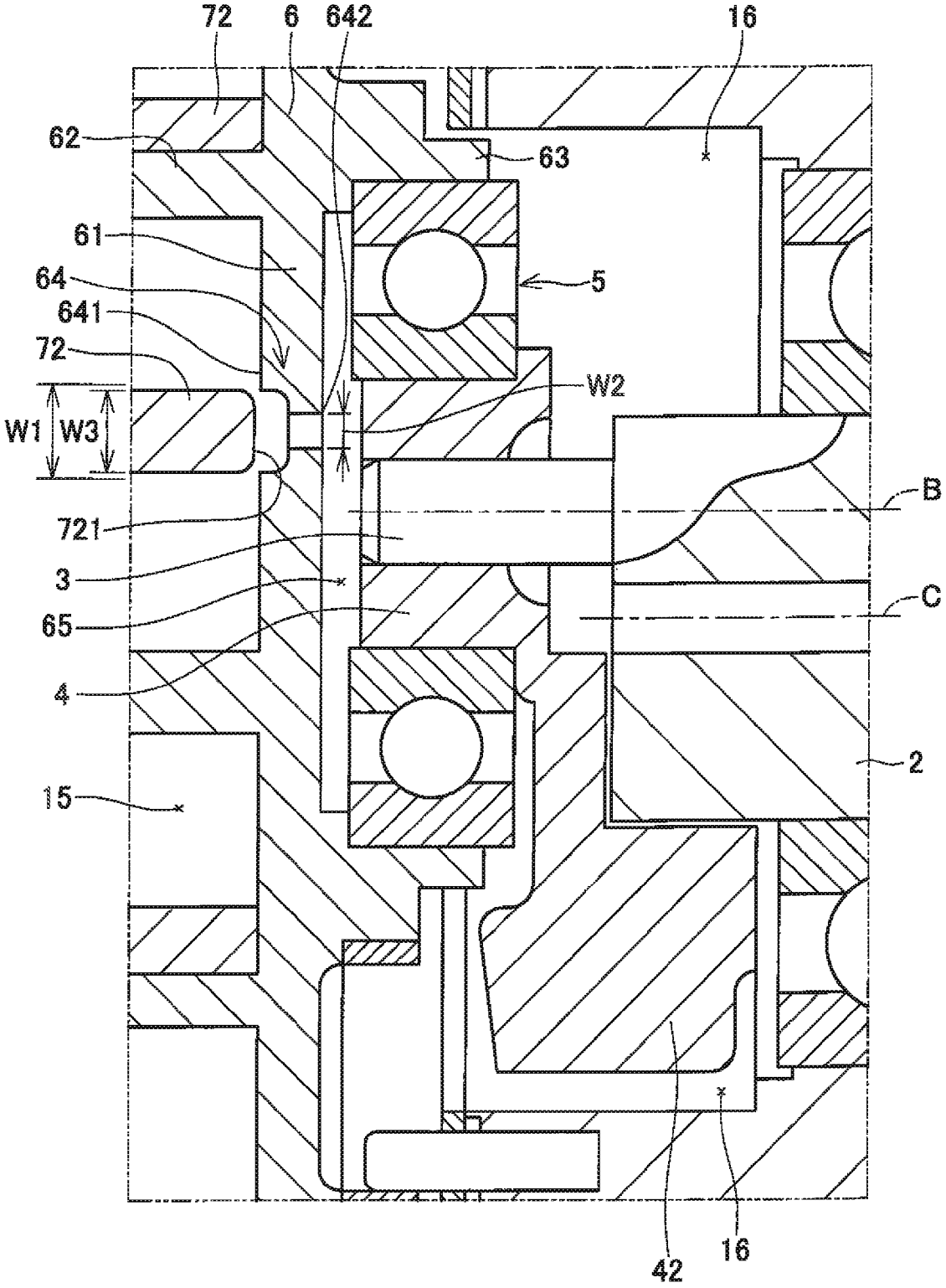
FIG. 6 is an enlarged view of a main portion of a scroll-type compressor according to another embodiment.

The embodiment has been described above, but the specific aspects of the invention are not limited to the above-described embodiment. For example, a position of the gas passage 64 is not particularly limited, and the gas passage 64 may be formed at a position facing the bush 4, as illustrated in FIG. 5. That is, the gas passage 64 is formed at a position facing an area on an inner side than the inner circumference of the bearing 5.

Moreover, the configuration of the gas passage 64 formed in the orbiting scroll 6 is not limited to the above-described embodiment. In the gas passage 64 according to another embodiment, when a wall, thickness w3 of the tip-end 721 of the fixed wall 72 is compared with a width w1 in a wall thickness direction of the tip-end 721 at the gas inlet 641 of the gas passage 64, w1 is equal to w3 or slightly larger than w3. The tip-end 721 is chamfered to have a round shape, and the gas inlet 641 is also chamfered to have a round shape. In this manner, even when the tip-end 721 of the fixed wall 72 overlaps the gas inlet 641, a small gap is formed between the tip-end 721 and the orbiting base plate 61. Thus, a part of the gas inlet 641 is open to the compression chamber 15, and the refrigerant gas flows into the gas passage 64 through the open portion. That is, the entire of the gas inlet 641 is not closed completely by the tip-end 721 of the fixed wall 72. By contrast, a width w2 in a wall thickness direction of the tip-end 721 at the gas outlet 642 of the gas passage 64 is smaller than the wall thickness w3 of the tip-end 721 of the fixed wall 72. That is, an opening cross section area of the gas outlet 642 is smaller than an opening cross section area of the gas inlet 641, and the gas passage 64 serves as a flow restrictor. Thus, the width of the gas passage 64 is gradually smaller from the gas inlet 641 toward the gas outlet 642, which inhibits the flow of the refrigerant gas. It should be noted that the width w1 of the gas inlet 641 and the width w2 of the gas outlet 642 are width in a same direction as the wall thickness w3 of the tip-end 721 when the tip-end 721 of the fixed wall 72 overlaps the gas inlet 641. According to such a configuration, the gas inlet 641 is not closed completely by the tip-end 721 of the fixed wall 72. Thus, even when the tip-end 721 overlaps the gas inlet 641, the gas can flow into the gas passage 64. In this manner, the refrigerant gas in the compression chamber 15 can flow to the back pressure chamber 16. In addition, a restrictor is formed by arranging the width w2 of the gas outlet 642 to be smaller than the width w3 of the tip-end 721, which prevents the overflow of the refrigerant gas through the gas passage 64. Therefore, the pressure of the compression chamber 15 is not reduced excessively. Thus, it is possible to make the refrigerant gas in the compression chamber 15 flow to the back pressure chamber 16 while maintaining the pressure of the refrigerant gas in the compression chamber 15. It should be noted that the gas passage 64 has two stages of width w1 and w2 in the embodiment, but the configuration is not limited thereto, and the gas passage 64 may have three or more stages of width.

Figure 7:
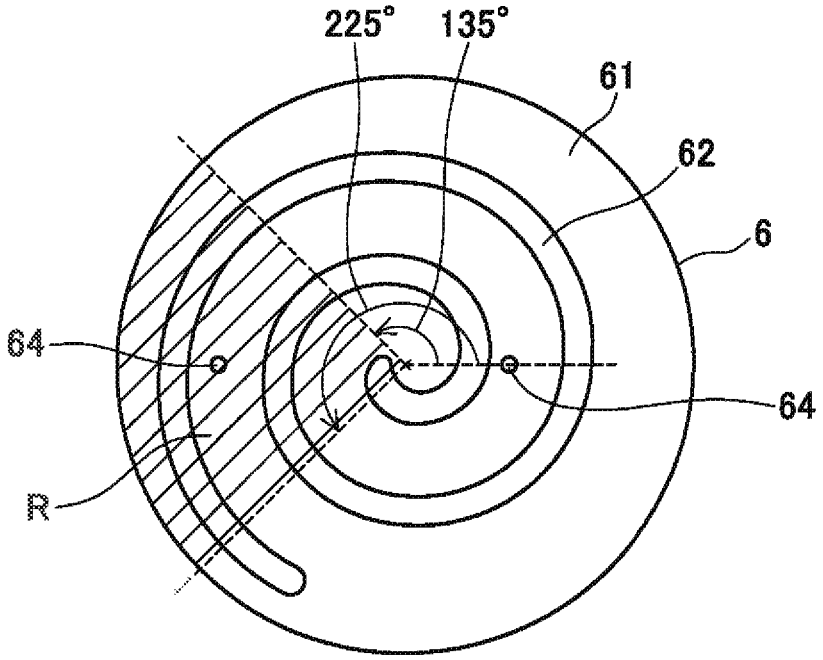
FIG. 7 is a plan view of an orbiting scroll according to another embodiment.

Moreover, one gas passage 64 is formed in the above-described embodiment, but the number of gas passages 64 is not particularly limited, and a plurality of gas passages 64 may be formed in the orbiting base plate 61. When a plurality of gas passages 64 are formed in the orbiting base plate 61, it is preferable to form the gas passages 64 in a well-balanced manner. For example, a pair of gas passages 64 can be formed at positions opposed to each other across a center of the orbiting base plate 61, as illustrated in FIG. 7. It is not necessary that the pair of gas passages 64 is arranged strictly at point symmetrical positions across the center point of the orbiting base plate 61. It is sufficient to form the gas passages 64 at areas substantially opposite to each other across the center of the orbiting base plate 61. To be more specific, one gas passage 64 is preferably formed in an area R (an area indicated by hatching in FIG. 7) from 135° to 225° with respect to the other gas passage 64 in a circumference direction of the orbiting base plate 61. According to such a configuration, it is possible to feed the refrigerant gas to the back pressure chamber 16 in a well-balanced manner in a circumference direction of the orbiting base plate 61 through the gas passages 64 opposed to each other with respect to the center of the orbiting base plate 61. Thus, it is possible to maintain the pressure balance of the refrigerant gas in the back pressure chamber 16 and press the orbiting scroll 6 in a well-balanced manner not so that the orbiting scroll 6 is inclined.

Figure 8:
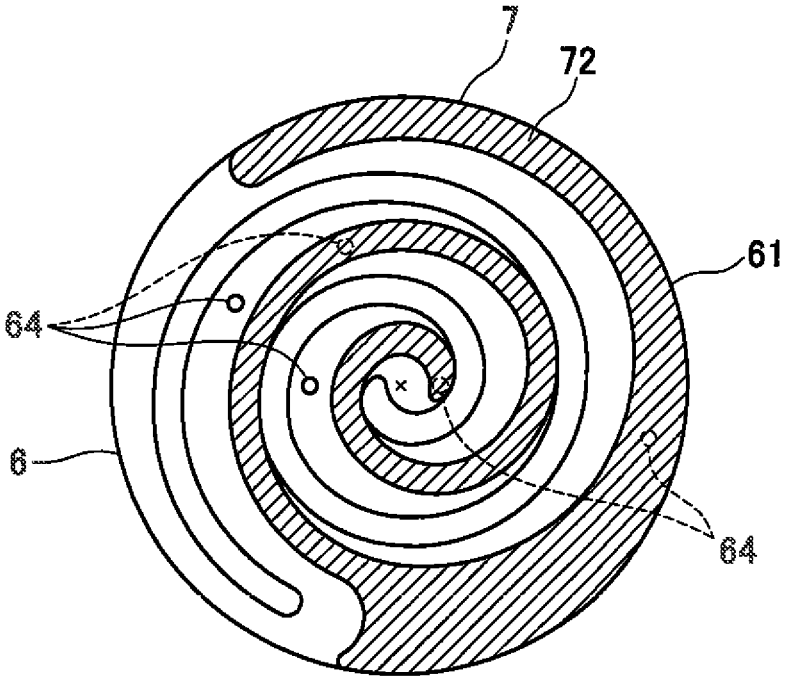
FIG. 8 is a plan view of an orbiting scroll according to another embodiment (a fixed wall is indicated by hatching).

Moreover, it is preferable that at least one of the plurality of gas passages 64 is continuously open, as illustrated in FIG. 8. To be more specific, the plurality of gas passages 64 is formed at positions so that all gas passages 64 are not overlapped by the fixed wall 72 (an hatching part) of the fixed scroll 7 at the same time. Therefore, at least one gas passage 64 is continuously exposed from the fixed wall 72. It should be noted that in case the gas passages 64 are arranged so that the openings of the inlets 641 of the gas passages 64 are arranged in the similar form as the spiral form of the fixed wall 72, all gas passages 64 would be overlapped by the fixed wall 72 at the same time and hidden. Therefore, it is sufficient that at least one of the gas passages 64 is disposed deviating from the spiral form of the fixed wall 72. According to such a configuration, all gas passages 64 are not covered by the fixed wall 72 at the same time, and at least one gas passage 64 is continuously open so that the gas can flow continuously through the gas passage 64, Therefore, it is possible to certainly feed the refrigerant gas to the back pressure chamber 16.

Moreover, the ball bearing is used as the bearing 5 in the above-described embodiment, but the configuration is not limited thereto, and a sliding bearing can be used.

What is claimed is:

1. A scroll-type compressor comprising:

a rotation shaft, the rotation shaft extending in an axial direction;

an eccentric shaft fixed to the rotation shaft, the eccentric shaft being offset from a rotation center of the rotation shaft;

a bush fitted onto the eccentric shaft;

a bearing disposed rotatably relative to the bush;

an orbiting scroll supported by the bearing;

a fixed scroll disposed to oppose the orbiting scroll;

a discharge chamber; and a partition wall supporting the rotation shaft and forming a back pressure chamber together with the orbiting scroll, wherein pressure in the back pressure chamber presses the orbiting scroll toward the fixed scroll, wherein the orbiting scroll comprises an orbiting base plate and an orbiting spiral wall projecting from the orbiting base plate toward the fixed scroll, the fixed scroll comprises a fixed base plate facing the orbiting base plate, and a fixed spiral wall projecting from the fixed base plate toward the orbiting scroll, wherein a discharge port is formed in the fixed base plate, the orbiting wall, the fixed wall, the orbiting base plate and the fixed base plate form a compression chamber, the discharge chamber is formed on the opposite side of the compression chamber with respect to the fixed base plate, the discharge chamber, the compression chamber, and the back pressure chamber are arranged along the axial direction in this order, the back pressure chamber communicates with the compression chamber, refrigerant gas in the compression chamber is compressed in accordance with orbiting motion of the orbiting scroll caused by rotation of the rotation shaft through revolution of the eccentric shaft, and is discharged from the compression chamber to the discharge chamber through the discharge port, a gas passage is formed in the orbiting base plate so as to communicate the compression chamber and the back pressure chamber, the orbiting base plate has a compression side surface and a back pressure chamber side surface, wherein the gas passage has an opening in the compression side surface of the orbiting base plate between portions of the orbiting spiral wall that face each other, and the gas passage has an opening in the back pressure side surface at a position that faces an area on a radially inner side than an outer circumference of the bearing, so as to feed the refrigerant gas in the compression chamber to the back pressure chamber, and the gas passage extends straight in the axial direction of the rotation shaft and pierces the orbiting base plate, wherein further a housing is provided with a suction port, and an inner portion of the housing communicates with the back pressure chamber through an exhaust passage formed in the rotation shaft.

2. The scroll-type compressor according to claim 1, wherein the gas passage serves as a flow restrictor.

3. The scroll-type compressor according to claim 1, wherein the gas passage opens and closes by the fixed wall.

4. The scroll-type compressor according to claim 1, wherein a plurality of gas passages is formed in the orbiting base plate; and at least one of the gas passages continuously communicates the compression chamber and the back pressure chamber so as to feed the refrigerant gas from the compression chamber to the back pressure chamber during operation of the orbiting scroll.

5. The scroll-type compressor according to claim 1, wherein a pair of gas passages is formed at positions opposed to each other with respect to a center of the orbiting base plate.

* * * * *